US006040128A

United States Patent [19]

Boettcher et al.

[11] Patent Number: 6,040,128

[45] Date of Patent: Mar. 21, 2000

[54] PROCESSES OF PREPARING RADIATION-SENSITIVE SILVER HALIDE EMULSIONS

[75] Inventors: John W. Boettcher, Webster; Seshadri Jagannathan; Michael W. Orem, both of Rochester; Philip J. Zola, Webster, all of N.Y.

[73] Assignee: Eastman Kodak Company, Rochester, N.Y.

[21] Appl. No.: 09/160,032

[22] Filed: Sep. 24, 1998

[51] Int. Cl.[7] ..... G03C 1/015; G03C 1/035; G03C 1/043

[52] U.S. Cl. ..... 430/569; 430/637

[58] Field of Search ..... 430/569, 637

[56] References Cited

U.S. PATENT DOCUMENTS

| | | | |
|---|---|---|---|
| 5,147,771 | 9/1992 | Tsaur et al. | 430/569 |
| 5,147,772 | 9/1992 | Tsaur et al. | 430/569 |
| 5,147,773 | 9/1992 | Tsaur et al. | 430/569 |
| 5,171,659 | 12/1992 | Tsaur et al. | 430/569 |
| 5,420,007 | 5/1995 | Goan | 430/569 |
| 5,460,937 | 10/1995 | Blease et al. | 430/569 |
| 5,468,602 | 11/1995 | Takahashi | 430/569 |
| 5,587,280 | 12/1996 | Ikeda et al. | 430/567 |
| 5,763,151 | 6/1998 | Brust et al. | 430/569 |
| 5,773,207 | 6/1998 | Barcock et al. | 430/567 |

FOREIGN PATENT DOCUMENTS

| | | | |
|---|---|---|---|
| 10/133316 | 5/1998 | Japan | G03C 1/035 |

*Primary Examiner*—Mark F. Huff
*Attorney, Agent, or Firm*—Carl O. Thomas; Andrew J. Anderson

[57] ABSTRACT

A process of preparing a radiation-sensitive silver halide emulsion is disclosed in which a polyalkylene oxide block copolymer surfactant is employed. Dispersion of the polyalkylene oxide block copolymer surfactant in the aqueous dispersing medium is increased by the inclusion of an auxiliary surfactant. The auxiliary surfactants are selected from among those that, in the form of an aqueous solution containing 10 percent by weight of the auxiliary surfactant based on total weight of the aqueous solution, is miscible in all proportions with at least one of water and the polyalkylene oxide block copolymer surfactant.

11 Claims, No Drawings

PROCESSES OF PREPARING RADIATION-SENSITIVE SILVER HALIDE EMULSIONS

FIELD OF THE INVENTION

The invention is directed to a process of preparing radiation-sensitive silver halide emulsions useful in photography.

DEFINITION OF TERMS

The term "surfactant" designates a compound that contains a hydrophilic moiety and a hydrophobic moiety. A compound can be a surfactant without being water soluble.

The term "equivalent circular diameter" or "ECD" in referring to a silver halide grain indicates the diameter of a circle having an area equal to the projected area of the grain.

A "tabular" grain is one in which the ratio of ECD to grain thickness (t) is at least two.

A tabular grain emulsion is one in which tabular grains account for greater than 50 percent of total grain projected area.

The "coefficient of variation" or "COV" of grain ECD is 100 times the standard deviation ($\sigma$) of grain ECD divided by mean grain ECD.

All references to silver halide grains and emulsions containing two or more halides name the halide in order of ascending concentrations.

The terms "high chloride" and "high bromide" refer to silver halide grains and emulsions in which chloride and bromide, respectively, account for greater than 50 mole percent of total halide, based on silver.

*Research Disclosure* is published by Kenneth Mason Publications, Ltd., Dudley House, 12 North St., Emsworth, Hampshire P010 7DQ, England.

BACKGROUND

Tsaur et al U.S. Pat. Nos. 5,147,771, 5,147,772 and 5,147,773 disclose the use of varied polyalkylene oxide block copolymer surfactants in the precipitation of radiation-sensitive tabular grain silver halide emulsions useful in photography. The polyalkylene oxide block copolymer surfactants are disclosed to be useful in reducing the proportion of unwanted grain shapes and decreasing grain dispersity, both in grain projected area and grain thickness. Tsaur et al U.S. Pat. No. 5,171,659 discloses the capability of polyalkylene oxide block copolymers to reduce the coefficient of variation of grain equivalent circular diameter to less than 10 percent. Numerous subsequent patents have applied the teachings of Tsaur et al to the preparation of silver halide emulsions for varied photographic and radiographic applications.

Although Tsaur et al dispersed the polyalkylene oxide block copolymers directly in the aqueous dispersing medium of silver halide precipitation reaction vessels, disadvantages with this approach have been observed. The high viscosity of the polyalkylene oxide block copolymers makes reproducibly accurate introductions of small amounts of the block copolymers difficult. Additionally, getting the block copolymers to disperse uniformly within the aqueous dispersing medium is difficult. Block copolymer dispersion non-uniformities are a significant contributor to batch-to-batch variations in emulsion characteristics.

When an addendum necessary to the preparation of a radiation-sensitive silver halide emulsion before, during or after grain formation does not disperse adequately in water, a common practice is to disperse the addendum in a water miscible organic solvent, such as acetone, methanol, ethanol, propanol, 2-methoxyethanol or 2-ethoxyethanol, prior to or during addition to the aqueous dispersing medium of the emulsion or in which the emulsion is to be formed. Illustrations of water miscible organic solvents used in silver halide emulsion preparation in combination with polyalkylene oxide block copolymers are provided by Goan U.S. Pat. No. 5,420,007, Takahashi U.S. Pat. No. 5,468,602, Ikeda et al U.S. Pat. No. 5,587,280 and Brust et al U.S. Pat. No. 5,763,151.

Unfortunately, the presence of water miscible organic solvents in emulsions can cause undesirable interactions with other components added during or subsequent to emulsion precipitation. For example, emulsions commonly include combinations of coating aids, coupler solvents and vehicle modifiers, and many of these materials can enter into unwanted interactions with one or more water miscible organic solvents resulting in emulsion coatings that are either physically degraded (e.g., non-uniform) or deficient in one or more photographic performance characteristics. Reductions in surface activity, crystallization, and flocculation are examples of unwanted physical effects.

Even when water miscible organic solvents are chosen that are compatible with the emulsion physical and photographic performance properties sought, there remains the problem of dealing with volatilization of the organic solvents from the emulsions and photographic coatings. Organic vapors are dangerous and burdensome to control within the confines of manufacturing operations. Emissions of organic vapors into the atmosphere are potentially damaging to the Earth's ecology and must be limited to satisfy government environmental protection requirements.

Blease et al U.S. Pat. No. 5,460,937 discloses a method of addition of solid hydrophobic photographically useful compounds into an aqueous photographic composition that eliminates the necessity of relying on a water miscible organic solvent. Particles of the hydrophobic photographically useful material are mixed with a hydrophilic solid material. The mixture is heated to its softening point and then expelled for rapid cooling, creating a solid mixture with a specific surface area of at least about 10 square centimeters per gram. The hydrophilic solid and the high specific surface area facilitate dispersion of the hydrophobic solid within an aqueous photographic composition. Hydrophobic photographically useful materials include spectral sensitizing dyes, absorbing dyes, antifoggants, antioxidants, nucleating agents, biostats, biocides, antifoamants, development accelerators, emulsion finish modifiers, image toners, optical brighteners, couplers, antistain agents, hardeners, storage stabilizers, and latent image stabilizers. The hydrophilic solid can take the form of water soluble polymer, employed alone or in combination with water soluble lower molecular weight materials having a melting point between 30 and 200° C.

SUMMARY OF THE INVENTION

In one aspect this invention is directed to a process of preparing a radiation-sensitive silver halide emulsion comprising reacting silver and halide ions in an aqueous dispersing medium to form radiation-sensitive silver halide grains in the presence of a polyalkylene oxide block copolymer surfactant, wherein dispersion of the polyalkylene oxide block copolymer surfactant in the aqueous dispersing medium is increased by the inclusion of an auxiliary surfactant that, in the form of an aqueous solution containing 10 percent by weight of the auxiliary surfactant based on total weight of the aqueous solution, is miscible in all proportions with at least one of water or the polyalkylene oxide block copolymer surfactant.

It has been discovered that presence of a water miscible auxiliary surfactant in an aqueous dispersing medium containing a polyalkylene oxide block copolymer surfactant increases the dispersity of the block copolymer surfactant. When water, the block copolymer and the auxiliary surfactant are mixed, a low viscosity liquid mixture results in which the block copolymer is uniformly dispersed, and this liquid mixture can be easily dispersed in the aqueous dispersing medium present in the reaction vessel prior to or during silver halide emulsion formation. This allows emulsion properties to be realized comparable to those currently realized by reliance on the presence of water miscible organic solvents. By eliminating water miscible organic solvents to disperse the block copolymers, the burden of controlling organic emissions is significantly abated.

DESCRIPTION OF PREFERRED EMBODIMENTS

This invention is directed to improved processes for the preparation of radiation-sensitive silver halide emulsions that employ polyalkylene oxide block copolymer surfactant in the aqueous dispersing medium of the emulsions during silver halide grain formation. Dispersion uniformity of the polyalkylene oxide block copolymer in the aqueous dispersing medium is increased by employing an auxiliary surfactant that, in the form of an aqueous solution containing 10 percent by weight of the auxiliary surfactant based on total weight of the aqueous solution, is miscible in all proportions with at least one of water and the polyalkylene oxide block copolymer surfactant. The required miscibility can be determined merely by dissolving in water sufficient surfactant to be tested for use as an auxiliary surfactant to form a 10 percent solution, based on total weight. To the resulting 10 percent solution is added either additional water or the polyalkylene alkylene oxide copolymer surfactant contemplated for use. Usually small increments of block copolymer or water are added followed after each addition by agitation. If the resulting solution remains clear, indicating no phase separation is occurring, an additional increment is added. Failure to observe a cloudy appearance after agitation establishes mutual miscibility.

The auxiliary surfactant can be chosen from among a wide variety of conventional anionic, cationic and nonionic surfactants. The following auxiliary surfactants have been used in preparing silver halide photographic and radiographic elements and are therefore recognized to exhibit general chemical compatibility. The optimum choice of an auxiliary surfactant is recognized to vary, depending upon the specific incorporation selections of other components within a specific photographic or radiographic element.

Anionic Auxiliary Surfactants

Aerosol A-102™ Cytec Industries
disodium ethoxylated alcohol half ester of sulfosuccinic acid
Aerosol A-103™ Cytec Industries
disodium ethoxylated nonylphenol half ester of sulfosuccinic acid
Aerosol A-196™ Cytec Industries
dialkylester of sodium sulfosuccinic acid
Aerosol AY™ Cytec Industries
diamyl ester of sodium sulfosuccinic acid
Aerosol IB-45™ Cytec Industries
di-isobutyl ester of sodium sulfosuccinic acid
Aerosol MA-80-I™ Cytec Industries
dihexyl ester of sodium sulfosuccinic acid
Aerosol OS™ Cytec Industries
sodium isopropylnaphthalene sulfonate
Aerosol 18™ Cytec Industries
disodium N-octadecylsulfosuccinamate
Aerosol 22™ Cytec Industries
tetrasodium-N-(1,2-dicarboxyethyl)-N-octadecylsulfosuccinamate
Alkanol XC™ E.I. Dupont de Nemours and Co.
a mixture of di and tri(isopropyl)naphthalene sulfonate, sodium salt
Dowfax 2A1™ Dow Chemical Co.
sodium dodecyl diphenyl ether disulfonate
Dowfax 3B2™ Dow Chemical Co.
sodium n-decyl diphenylether disulfonate
Duponol C™ Witco Corp.
sodium lauryl sulfate
Duponol D™ Witco Corp.
mixture of sodium lauryl sulfonate and oleyl sulfates
Duponol EP™ Witco Corp.
diethanol amine lauryl sulfate
Duponol SN™ Witco Corp.
mixture of sodium decyl and lauryl sulfate
Duponol WA™ Witco Corp.
sodium lauryl sulfate
Duponol WN™ Witco Corp.
mixture of sodium octyl sulfate and sodium decylsulfate
Emcol K-8300™ Witco Corp.
disodium sulfosuccinate, half ester
Rhodapon TDS™ Rhone-Poulenc
sodium tridecylsulfate
Tergitol 7™ Union Carbide Co.
sodium sulfate of 3,9-diethyltridecanol-6
Triton X-200™ Union Carbide Co.
sodium octylphenol poly(ethylene oxide)sulfonate
Triton X-301™ Union Carbide Co.
sodium octylphenol poly(ethylene oxide)sulfate
Triton 770™ Union Carbide Co.
sodium octylphenol poly(ethylene oxide)sulfate

Cationic Auxiliary Surfactants

Adogen 464™ Witco Corp.
octyl and decyl trimethylammonium chloride
Atlas G-263™ ICI Americas Inc.
N-cetyl,N-ethyl morpholinium ethosulfate
Ethoquad C/25™ Akzo Nobel Chemicals Inc.
coco (omega-hydroxy,hepta-ethoxy)-(omega-hydroxy, octa-ethoxy)-methyl ammonium chloride

Nonionic Auxiliary Surfactants

Olin 10G™ Olin Corp.
nonylphenoxydecaglycidol
Triton CF-10™ Union Carbide Co.
aryl-terminated polyethoxylated alkylphenol
Triton CF-54™ Union Carbide Co.
alkyl-terminated polyethoxylated alkylphenol
Triton DF-12™ Union Carbide Co.
modified polyethoxylated straight-chain alcohol Triton DF-16™ Union Carbide Co.

alkyl-terminated polyethoxylated straight-chain alcohol

Triton DF-18™ Union Carbide Co.

modified polyethoxylated straight-chain alcohol

Triton N-101™ Union Carbide Co.

nonylphenoxy polyethoxy ethanol

Triton N-111™ Union Carbide Co.

nonylphenoxy polyethoxy ethanol

Triton X-100™ Union Carbide Co.

octylphenoxy$(CH_2CH_2O)_{9.5}H$

Triton X-102™ Union Carbide Co.

octylphenoxy$(CH_2CH_2O)_{12.5}H$

Triton X-165™ Union Carbide Co.

octylphenoxy$(CH_2CH_2O)_{16}H$

The polyalkylene oxide block copolymer surfactants conventionally employed as emulsion dispersing media addenda exhibit limited solubility in water. This invention is particularly useful with those block copolymer surfactants that demonstrate phase separation when mixed with water in concentrations of 10 percent by weight, based on total weight. Most of these block copolymer surfactants show separation when mixed with water in concentrations well below 10 percent by weight (e.g., down 1 percent by weight, based on total weight). A general review of block copolymer surfactants is provided by I. R. Schmolka, "A Review of Block Polymer Surfactants", J. Am. Oil Chem. Soc., Vol. 54, No. 3, 1977, pp. 110–116, and A. S. Davidsohn and B. Milwidsky, *Synthetic Detergents,* John Wiley & Sons, N.Y. 1987, pp. 29–40, and particularly pp. 34–36.

One category of polyalkylene oxide block copolymer surfactant found to be useful in the preparation of the emulsions is comprised of two terminal lipophilic alkylene oxide block units linked by a hydrophilic alkylene oxide block unit accounting for at least 4 percent of the molecular weight of the copolymer. These surfactants are hereinafter referred to category S-I surfactants.

The category S-I surfactants contain at least two terminal lipophilic alkylene oxide block units linked by a hydrophilic alkylene oxide block unit and can be, in a simple form, schematically represented as indicated by diagram I below:

(I)

| | | |
|---|---|---|
| LAO1 | HAO1 | LAO1 |

where

LAO1 in each occurrence represents a terminal lipophilic alkylene oxide block unit and HAO1 represents a linking hydrophilic alkylene oxide block unit.

It is generally preferred that HAO1 be chosen so that the hydrophilic block unit constitutes from 4 to 50 percent of the block copolymer on a total weight basis.

It is, of course, recognized that the block diagram I above is only one example of a polyalkylene oxide block copolymer having at least two terminal lipophilic block units linked by a hydrophilic block unit. In a common variant structure interposing a trivalent amine linking group in the polyalkylene oxide chain at one or both of the interfaces of the LAO1 and HAO1 block units can result in three or four terminal lipophilic groups.

In their simplest possible form the category S-I polyalkylene oxide block copolymer surfactants are formed by first condensing ethylene glycol and ethylene oxide to form an oligomeric or polymeric block repeating unit that serves as the hydrophilic block unit and then completing the reaction using 1,2-propylene oxide. The propylene oxide adds to each end of the ethylene oxide block unit. At least six 1,2-propylene oxide repeating units are required to produce a lipophilic block repeating unit. The resulting polyalkylene oxide block copolymer surfactant can be represented by formula II:

(II)

$$HO-(\overset{CH_3}{\overset{|}{C}}HCH_2O)_x-(CH_2CH_2O)_y-(\overset{CH_3}{\overset{|}{C}}H_2CHO)_{x'}-H$$

where x and x' are each at least 6 and can range up to 120 or more and y is chosen so that the ethylene oxide block unit maintains the necessary balance of lipophilic and hydrophilic qualities necessary to retain surfactant activity. It is generally preferred that y be chosen so that the hydrophilic block unit constitutes from 4 to 50 percent by weight of the total block copolymer. Within the above ranges for x and x', y can range from 2 to 240 or more.

Generally any category S-I surfactant block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 16,000, preferably less than about 10,000, are contemplated for use.

In a second category, hereinafter referred to as category S-II surfactants, the polyalkylene oxide block copolymer surfactants contain two terminal hydrophilic alkylene oxide block units linked by a lipophilic alkylene oxide block unit and can be, in a simple form, schematically represented as indicated by diagram III below:

(III)

| | | |
|---|---|---|
| HAO2 | LAO2 | HAO2 |

where

HAO2 in each occurrence represents a terminal hydrophilic alkylene oxide block unit and LAO2 represents a linking lipophilic alkylene oxide block unit.

It is generally preferred that LAO2 be chosen so that the lipophilic block unit constitutes from 50 to 96 percent of the block copolymer on a total weight basis.

It is, of course, recognized that the block diagram III above is only one example of a category S-II polyalkylene oxide block copolymer having at least two terminal hydrophilic block units linked by a lipophilic block unit. In a common variant structure interposing a trivalent amine linking group in the polyakylene oxide chain at one or both of the interfaces of the LAO2 and HAO2 block units can result in three or four terminal hydrophilic groups.

In their simplest possible form the category S-II polyalkylene oxide block copolymer surfactants are formed by first condensing 1,2-propylene glycol and 1,2-propylene oxide to form an oligomeric or polymeric block repeating unit that serves as the lipophilic block unit and then completing the reaction using ethylene oxide. Ethylene oxide is added to each end of the 1,2-propylene oxide block unit. At least thirteen (13) 1,2-propylene oxide repeating units are required to produce a lipophilic block repeating unit. The resulting polyalkylene oxide block copolymer surfactant can be represented by formula IV:

(IV)

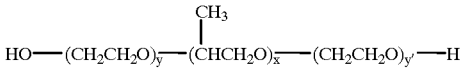

where x is at least 13 and can range up to 490 or more and y and y' are chosen so that the ethylene oxide block units maintain the necessary balance of lipophilic and hydrophilic qualities necessary to retain surfactant activity. It is generally preferred that x be chosen so that the lipophilic block unit constitutes from 50 to 96 percent by weight of the total block copolymer; thus, within the above range for x, y and y' can range from 1 to 320 or more.

Any category S-II block copolymer surfactant that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 30,000, preferably less than about 20,000, are contemplated for use.

In a third category, hereinafter referred to as category S-III surfactants, the polyalkylene oxide surfactants contain at least three terminal hydrophilic alkylene oxide block units linked through a lipophilic alkylene oxide block linking unit and can be, in a simple form, schematically represented as indicated by formula V below:

(V)

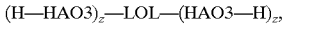

where

HAO3 in each occurrence represents a terminal hydrophilic alkylene oxide block unit, LOL represents a lipophilic alkylene oxide block linking unit, z is 2 and z' is 1 or 2.

The polyalkylene oxide block copolymer surfactants employed can take the form shown in formula VI:

(VI)

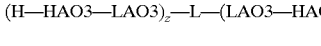

where

HAO3 in each occurrence represents a terminal hydrophilic alkylene oxide block unit, LAO3 in each occurrence represents a lipophilic alkylene oxide block unit, L represents a linking group, such as amine or diamine, z is 2 and z' is 1 or 2.

The linking group L can take any convenient form. It is generally preferred to choose a linking group that is itself lipophilic. When z+z' equal three, the linking group must be trivalent. Amines can be used as trivalent linking groups. When an amine is used to form the linking unit L, the polyalkylene oxide block copolymer surfactants employed can take the form shown in formula VII:

(VII)

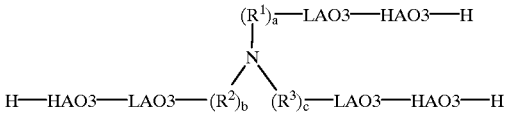

where

HAO3 and LAO3 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula XIV.

When z+z' equal four, the linking group must be tetravalent. Diamines are preferred tetravalent linking groups. When a diamine is used to form the linking unit L, the polyalkylene oxide block copolymer surfactants employed can take the form shown in formula VIII:

(VIII)

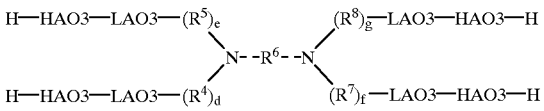

where

HAO3 and LAO3 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

It is generally preferred that LAO3 be chosen so that the LOL lipophilic block unit accounts for from 50 to 95 percent, optimally 50 to 90 percent, of the molecular weight of the copolymer.

In a fourth category, hereinafter referred to as category S-IV surfactants, the polyalkylene oxide block copolymer surfactants employed contain at least three terminal lipophilic alkylene oxide block units linked through a hydrophilic alkylene oxide block linking unit and can be, in a simple form, schematically represented as indicated by formula IX below:

(IX)

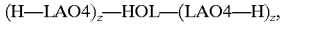

where

LAO4 in each occurrence represents a terminal lipophilic alkylene oxide block unit, HOL represents a hydrophilic alkylene oxide block linking unit, z is 2 and z' is 1 or 2.

The polyalkylene oxide block copolymer surfactants employed can take the form shown in formula X:

(X)

$$(H—LAO4—HAO4)_z—L'—(HAO4—LAO4—H)_{z'}$$

where

HAO4 in each occurrence represents a hydrophilic alkylene oxide block unit,

LAO4 in each occurrence represents a terminal lipophilic alkylene oxide block unit, L' represents a linking group, such as amine or diamine, z is 2 and z' is 1 or 2.

The linking group L' can take any convenient form. It is generally preferred to choose a linking group that is itself hydrophilic. When z+z' equal three, the linking group must be trivalent. Amines can be used as trivalent linking groups. When an amine is used to form the linking unit L', the polyalkylene oxide block copolymer surfactants employed can take the form shown in formula XI:

(XI)

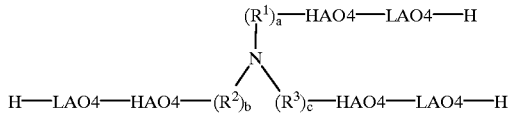

where

HAO4 and LAO4 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula XI.

When z+z' equal four, the linking group must be tetravalent. Diamines are preferred tetravalent linking groups. When a diamine is used to form the linking unit L', the polyalkylene oxide block copolymer surfactants employed can take the form shown in formula XII:

(XII)

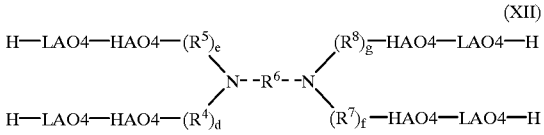

where

HAO4 and LAO4 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

It is generally preferred that LAO4 be chosen so that the HOL hydrophilic block unit accounts for from 4 to 50 percent of the molecular weight of the copolymer.

In their simplest possible form the polyalkylene oxide block copolymer surfactants of categories S-III and S-IV employ ethylene oxide repeating units to form the hydrophilic (HAO3 and HAO4) block units and 1,2-propylene oxide repeating units to form the lipophilic (LAO3 and LAO4) block units. At least three propylene oxide repeating units are required to produce a lipophilic block repeating unit. When so formed, each H—HAO3—LAO3— or H—LAO4—HAO4— group satisfies formula XIIIa or XIIIb, respectively:

(XIIIa)

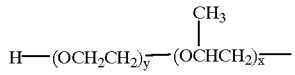

(XIIIb)

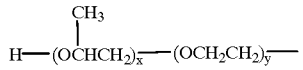

where x is at least 3 and can range up to 250 or more and y is chosen so that the ethylene oxide block unit maintains the necessary balance of lipophilic and hydrophilic qualities necessary to retain surfactant activity. This allows y to be chosen so that the hydrophilic block units together constitute from greater than 4 to 50 percent (optimally 10 to 50 percent) by weight of the total block copolymer. In this instance the lipophilic alkylene oxide block linking unit, which includes the 1,2-propylene oxide repeating units and the linking moieties, constitutes from 50 to 96 percent (optimally 50 to 90 percent) of the total weight of the block copolymer. Within the above ranges, y can range from 1 (preferably 2) to 340 or more.

The overall molecular weight of the polyalkylene oxide block copolymer surfactants of categories S-III and S-IV have a molecular weight of greater than 1100, preferably at least 2,000. Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general category S-III surfactants having molecular weights of less than about 60,000, preferably less than about 40,000, are contemplated for use, category S-IV surfactants having molecular weight of less than 50,000, preferably less than about 30,000, are contemplated for use.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other allylene oxide repeating units can, if desired, be substituted in any of the category S-I, S-II, S-III and S-IV surfactants, provided the intended lipophilic and hydrophilic properties are retained. For example, the propylene oxide repeating unit is only one of a family of repeating units that can be illustrated by formula XIV.

(XIV)

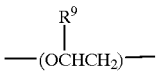

where $R^9$ is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula XV:

(XV)

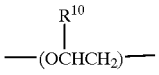

where $R^{10}$ is hydrogen or a hydrophilic group, such as a hydrocarbon group of the type forming $R^9$ above additionally having one or more polar substituents—e.g., one, two, three or more hydroxy and/or carboxy groups.

In each of the surfactant categories each of the block units contain a single alkylene oxide repeating unit selected to impart the desired hydrophilic or lipophilic quality to the block unit in which it is contained. Hydrophilic-lipophilic balances (HLB's) of commercially available surfactants are generally available and can be consulted in selecting optimum surfactants for a selected application.

Silver halide emulsions are usually precipitated using one of the following general approaches: single-jet precipitation, batch double-jet precipitation, or continuous double-jet precipitation.

During single-jet precipitation a soluble halide salt (e.g., alkali, alkaline earth or ammonium halide) is initially dissolved in an aqueous dispersing medium within the reaction vessel. Grain precipitation (grain nuclei formation and grain growth) occurs as an aqueous silver salt (e.g., silver nitrate) solution is run into the reaction vessel. Since precipitation begins with a large halide ion stoichiometric excess that progressively declines as precipitation proceeds, single-jet emulsions are characterized by wide grain-to-grain variations, both in size and shape.

To obtain more nearly uniform grain populations, the most common precipitation technique is the batch double-jet precipitation technique. In this technique an aqueous dispersing medium is placed in a reaction vessel and adjusted to an initial halide ion concentration optimum for the type of grain sought to be precipitated. A soluble silver salt solution is added to the reaction vessel through a first jet while a soluble halide salt solution is added to the reaction vessel through a second jet. This precipitation approach allows any selected stoichiometric excess of halide ion over silver ion to be maintained. Low COV grain populations can be readily precipitated. Additionally, a high degree of uniformity of any selected common grain shape can be realized. Although two separate addition jets are required as a minimum, additional jets can be used to add a second halide, additional dispersing medium, or other addenda. All of the product emulsion silver halide grains remain in the reaction vessel at the conclusion of precipitation.

Continuous double-jet precipitations differ from the batch double-jet approach in that a steady-state flow of materials through the reaction vessel occurs while precipitation is continuing. That is, emulsion is withdrawn at a rate chosen to balance the rate of materials addition. Since grain nucleation continues throughout the precipitation and some grains remain in the reaction vessel longer than others, the grain population within the reaction is always polydisperse, even after steady state precipitation conditions are reached.

A common variation of the batch double-jet precipitation technique is to use a low volume double-jet continuous reactor to precipitate fine silver halide grains. These grains are then introduced into a batch double-jet reaction vessel as a replacement for the soluble silver and halide salt jet additions. The fine grains dissolve in the reaction vessel and provide a source of soluble silver and halide ions for driving grain growth. The first fine grains introduced can serve as nuclei for subsequent grain growth. The degree of grain uniformity with this variant precipitation technique, commonly referred to as "dual zone" double-jet precipitation, can equal or even exceed that obtained by the soluble silver and halide salt solution addition batch double-jet approach described above.

Tabular grain emulsions are generally regarded as the most difficult of commonly employed photographic emulsions to produce with a high degree of grain uniformity. Tabular grain precipitation, usually undertaken by the batch double-jet or dual-zone precipitation techniques described above, suffers from inherent non-uniformities in grain nucleation in addition to the factors contributing to non-uniformities in grain growth exhibited by other silver halide grains. The reason for grain nucleation non-uniforminities is that even under the most favorable conditions only a fraction of the grain nuclei precipitated contain the crystal lattice irregularities required for growth into tabular grains. It is necessary to ripen out the highest possible proportion of the grain nuclei lacking tabular growth capability so that the remaining grains can grow into tabular grains. Tabular grains grow laterally much more rapidly than non-tabular grains, thereby increasing overall emulsion grain COV's when both tabular and non-tabular grain populations are present.

The present invention increases the uniformity of polyalkylene oxide block copolymer introduced into the aqueous dispersing medium of a silver halide emulsion during its formation to decrease grain-to-grain variances.

A primary use of polyalkylene oxide block copolymer surfactants has been to reduce the dispersity of tabular grain emulsions. Analogous uses of polyalkylene oxide block copolymer surfactants are contemplated to decrease the dispersity of any of the silver halide emulsions resulting from the general precipitation approaches described above.

Regardless of the type of emulsion preparation process employed or the type of silver halide grains being formed, the effectiveness of the polyalkylene oxide block copolymer surfactants in reducing grain-to-grain variance is highest when the block copolymer surfactant is introduced into the dispersing medium of the reaction vessel prior to grain nucleation or, if not present during grain nucleation, then prior to precipitating up to 2 percent of the total silver forming the final grain population. The block copolymer surfactant can be introduced later in the grain growth, but in all instances, to achieve significant enhancements of grain properties, it is contemplated that the polyalkylene oxide block copolymer surfactant will be present in the dispersing medium of the emulsion prior to precipitating at least 50 percent of the total silver forming the product silver halide grains.

In preparing silver halide emulsions by batch methods it is common practice to initially locate in the reaction vessel at least 10 (more commonly at least 20) percent of the dispersing medium present at the conclusion of grain formation. In continuous double-jet makes and in some forms of batch double-jet in which water and dissolved salts are continuously removed by ultrafiltration (e.g., Mignot U.S. Pat. No. 4,334,012) the initial and final volumes of the dispersing medium can remain unchanged despite materials additions during silver halide grain preparation. More commonly the volume of the dispersing medium in batch precipitations is less than 80 percent of the final volume of the emulsion.

The dispersing medium, apart from the surfactants, initially present in the reaction vessel is water or a dispersion of a silver halide peptizer in water. Minor amounts of other addenda, such as ripening agents, dopants, etc. can also be present. It is possible to nucleate silver halide grains in the absence of a peptizer, but more commonly at least 10 (preferably at least 20) percent of the peptizer present at the completion of precipitation is present in the reaction vessel prior to grain nucleation. Any conventional level of peptizer can be employed during grain nucleation and growth.

Additionally, a minor proportion of the halide salt to be reacted is introduced into the reaction vessel dispersing medium prior to grain nucleation. This is done to assure a stoichiometric excess of halide ion in the dispersing medium (thereby avoiding fog) and to select the ideal conditions for realizing the desired grain morphology (e.g., the crystal lattice orientation of grain faces and the presence or absence of crystal lattice irregularities, such as twin planes).

The concentration of the polyalkylene oxide block copolymer surfactant in the dispersing medium is in all instances at least 0.1 percent by weight, based on the weight of silver present at any given point in the grain formation process. Preferably the block copolymer surfactant is present in a concentration of at least 1 percent by weight based on the weight of silver present in the reaction vessel. Very high concentrations of the block copolymer surfactant have been investigated ranging up to 10 times the interim weight of silver present in the reaction vessel. However, no performance advantages have been observed at concentrations of the block copolymer surfactant higher than 7 times the interim weight of silver.

To avoid phase separation and thereby assure uniform dispersion of the block copolymer surfactant in the dispersing medium of the reaction vessel, the block copolymer surfactant is preferably premixed with water and auxiliary surfactant prior to addition to the reaction vessel. Concentrations of the auxiliary surfactant of 1 percent by weight, based on the weight of the three component mixture, and higher have been observed to achieve solubility of the polyalkylene oxide block copolymer. The polyalkylene oxide can be dispersed in the three component mixture without phase separation (i.e., turbidity) at concentrations of up to 10 percent by weight, based on total weight, using any of the auxiliary surfactants. Depending upon the choice of the auxiliary surfactants, block copolymer surfactant concentrations ranging up to and even above 80 percent by weight, based on total weight, have been observed in the three component mixture without phase separation.

Optimum choices of ingredient proportions in the three component mixture vary with the particular type of auxiliary surfactant selected. One preferred class of auxiliary surfactants are those that, when tested as 10 percent by weight aqueous solutions, based on total weight, are miscible in all proportions with water and also miscible in all proportions with the polyalkylene oxide block copolymer. This class of auxiliary surfactants have been noted to be effective in dispersing the polyalkylene oxide block copolymers in the three component mixture at concentrations of down to 2 percent by weight and lower, over the widest useful concentration ranges of water and the block copolymer surfactant.

Some of the auxiliary surfactants are those that, when tested as 10 percent by weight aqueous solutions, based on total weight, are miscible in all proportions with water but show limited miscibility with the polyalkylene oxide block copolymer. These auxiliary surfactants are most effective in the lower ranges of block copolymer concentrations in the three component mixture.

In still another class are auxiliary surfactants that, when tested as 10 percent by weight aqueous solutions based on total weight, are miscible in all proportions with the polyalkylene oxide block copolymer, but exhibited limited solubility in water. Auxiliary surfactants in this class are highly useful, since only a small (e.g., less than 2 percent) addition of the auxiliary surfactant is required to allow single phase three component mixtures to be realized over a broad range of water and block copolymer surfactant proportions, excluding only three component mixtures in which the concentrations of both the auxiliary surfactant and the block copolymer surfactant are low—e.g., less than 20 percent by weight of the block copolymer surfactant and less than 1 percent by weight of the auxiliary surfactant. Thus, a significant advantage in using this class of auxiliary surfactants results from the fact that increasing the concentration of the block copolymer surfactant to the highest contemplated levels noted above does not present any risk of phase separation in the three component mixture, provided at least a minimal amount of the auxiliary surfactant of this class is present.

When the three component mixture is introduced into the reaction vessel, it is immediately dispersed throughout the dispersing medium within the reaction vessel, since highly efficient stirring mechanisms within the reaction vessel are conventionally employed throughout silver halide emulsion preparation.

Apart from the features described above, the processes of the invention can employ conventional procedures and materials selections in preparing silver halide emulsions. The disclosures of the following patents that employ polyalkylene oxide block copolymers in emulsion preparation are here incorporated by reference:

| | |
|---|---|
| Tsaur et al | U.S. Pat. No. 5,147,771; |
| Tsaur et al | U.S. Pat. No. 5,147,772; |
| Tsaur et al | U.S. Pat. No. 5,147,773; |
| Tsaur et al | U.S. Pat. No. 5,171,773; |
| Tsaur et al | U.S. Pat. No. 5,252,453; |
| Kim et al | U.S. Pat. No. 5,272,048; |
| Sutton et al | U.S, Pat. No. 5,334,469; |
| Goan | U.S. Pat. No. 5,420,007; |
| Takahashi | U.S. Pat. No. 5,468,602; |
| Fenton et al | U.S. Pat. No. 5,470,760; |
| Ikeda et al | U.S. Pat. No. 5,587,280; |
| Deaton et al | U.S. Pat. No. 5,726,007; and |
| Brust et al | U.S. Pat. No. 5,763,151. |

A summary of conventional features of silver halide emulsion grains and their preparation is contained in *Research Disclosure,* Vol. 389, September 1996, Item 38957, I. Emulsion grains and their preparation A. Grain halide composition B. Grain morphology C. Grain modifying conditions and adjustments Although the processes of this invention are generally applicable to silver halide emulsion preparation, the invention is particularly contemplated for use in the preparation of high bromide silver halide emulsions, particularly silver bromide, silver iodobromide, silver chlorobromide, silver iodochlorobromide and silver chloroiodobromide emulsions.

The processes of the invention are useful in preparing silver halide emulsions having either regular or irregular grains. For example, the formation of regular grains, such as octahedral, cubic and cubo-octahedral grains is contemplated. Irregular grain emulsions, such as tabular grain emulsions containing tabular grains having {111} major faces are specifically contemplated. These grains are known to contain parallel twin planes.

One of the advantages realized by the presence of polyalkylene oxide block copolymer surfactant during grain formation is a general lowering of grain dispersity, both in terms of the variation of grain sizes and shapes. Emulsions produced by the process of the invention generally exhibit a COV of less than 25 percent. The invention allows extremely low dispersity levels. COV levels of less than 10 percent can be realized in preparing tabular grain emulsions and COV levels of 5 percent and lower can be realized in preparing regular grain emulsions. Tabular grain emulsions can be prepared by the processes of the invention exhibiting tabular grain projected areas that account for substantially all (e.g., >97%) of total grain projected area. The preparation of tabular grain emulsions with very low levels of tabular grain thickness variation are disclosed by Sutton et al U.S. Pat. No. 5,334,469 and can be realized by the practice of this invention.

The peptizers employed during emulsion preparation can be selected from those disclosed in *Research Disclosure,* Item 38957, II. Vehicles, vehicle extenders, vehicle-like addenda and vehicle related addenda A. Gelatin and hydrophilic colloid peptizers Although gelatin and gelatin derivatives are most commonly employed in silver halide emulsion preparation, it is specifically contemplated as an optional alternative to employ as a water soluble hydrophilic colloid peptizer a water soluble catonic starch, as taught by Maskasky U.S. Pat. No. 5,604,085, or a water soluble oxidized cationic starch, as taught by Maskasky U.S. Pat. No. 5,607,828. Other illustrations of the starch and starch derivative peptizers being employed in silver halide emulsion precipitation are provided by Maskasky U.S. Pat. Nos. 5,620,840; 5,629,142; 5,667,955; 5,691,131; and 5,726,008. Maskasky U.S. Pat. No. 5,693,459 is specifically directed to use of the starch class of peptizers in combination with polyallylene oxide block copolymer surfactants during emulsion preparation. The Maskasky patents cited above are here incorporated by reference.

Following silver halide emulsion preparation the emulsions are usually washed and then sensitized. Addenda, such as antifoggants and stabilizers are added. It is recognized that sensitizers and stabilizers are in some instances present during emulsion preparation; however, these inclusions can be accommodated without any basic modifications of the preparation procedures described above.

Techniques for proceeding from preparation of radiation-sensitive silver halide emulsions to their incorporation in photographic and radiographic elements, exposure and processing are conventional and are summarized in *Research Disclosure,* Item 38957.

EXAMPLES

The invention can be better appreciated by reference to the following specific embodiments.

Representative Auxiliary Surfactants

AS-1 Alkanol XC™ E.I. Dupont de Nemours and Co.
a mixture of di and tri(isopropyl)naphthalene sulfonate, sodium salt AS-2 Sodium dodecylsulfate AS-3 Dodecyltrimethylammonium bromide AS-4 Triton X-165™ Union Carbide Co.
octylphenoxy$(CH_2CH_2O)_{16}H$ AS-5 Triton X-200™ Union Carbide Co.
sodium octylphenoxy$(CH_2CH_2O)_2$ethylsulfonate AS-6 Olin 10G™ Olin Corp.
nonylphenoxydecaglycidol

Three Component Mixtures

A 10% by weight, based on total weight, solution of the representative auxiliary surfactant in water was prepared. One portion was reserved while the polyalkylene oxide block copolymer surfactant (POBCS) Pluronic 31R1™ (x=25, x'=25, y=7, formula II) in amounts of 20%, 40%, 50%, 60% and 80% by weight, based on total weight, was added separate portions of the 10% auxiliary surfactant solution. Each sample was observed for evidence of phase separation (turbidity). Thereafter, distilled water (DW) was added to each sample. After approximately 20% by weight, based on total weight, of the distilled water was added to each sample, the samples were again observed for phase separation. Then the level of distilled water addition was raised to approximately 40%, 50%, 60%, 80% and 90% by weight, based on total weight, in each sample with each sample being observed for phase separation at each distilled water addition level.

The results are summarized in Table Ia below for auxiliary surfactant AS-1 with no POBCS added.

TABLE Ia

| AS-1, 0% POBCS | | |
|---|---|---|
| Sample # | DW added wt. % | Phase Separation |
| 0 | 0 | no |
| 1 | 20 | no |
| 2 | 40 | no |
| 3 | 50 | no |
| 4 | 60 | no |
| 5 | 80 | no |
| 6 | 90 | no |

This established that the AS-1 10% solution was fully miscible with water in all proportions in the absence of POBCS.

The results summarized in Table Ib below show the effect of adding varied amounts distilled water to Sample 0 modified by the addition of 20% by weight, based on total weight, POBCS.

TABLE Ib

| AS-1, 20% POBCS | | |
|---|---|---|
| Sample # | DW added wt. % | Phase Separation |
| 7 | 0 | no |
| 8 | 20 | no |
| 9 | 40 | no |
| 10 | 50 | no |
| 11 | 60 | no |
| 12 | 80 | no |
| 13 | 90 | no |

The results summarized in Table Ic below show the effect of adding varied amounts distilled water to Sample 0 modified by the addition of 40% by weight, based on total weight, POBCS.

TABLE Ic

| AS-1, 40% POBCS | | |
|---|---|---|
| Sample # | DW added wt. % | Phase Separation |
| 14 | 0 | yes |
| 15 | 20 | yes |
| 16 | 40 | no |
| 17 | 50 | no |
| 18 | 60 | no |
| 19 | 80 | no |
| 20 | 90 | no |

The results summarized in Table Id below show the effect of adding varied amounts distilled water to Sample 0 modified by the addition of 50% by weight, based on total weight, POBCS.

TABLE Id

| AS-1, 50% POBCS | | |
|---|---|---|
| Sample # | DW added wt. % | Phase Separation |
| 21 | 0 | yes |
| 22 | 20 | yes |
| 23 | 40 | no |
| 24 | 50 | no |
| 25 | 60 | no |
| 26 | 80 | no |
| 27 | 90 | no |

The results summarized in Table Ie below show the effect of adding varied amounts distilled water to Sample 0 modified by the addition of 60% by weight, based on total weight, POBCS.

TABLE Ie

| AS-1, 60% POBCS | | |
|---|---|---|
| Sample # | DW added wt. % | Phase Separation |
| 28 | 0 | yes |
| 29 | 20 | yes |
| 30 | 40 | yes |
| 31 | 50 | no |
| 32 | 60 | no |

TABLE Ie-continued

| AS-1, 60% POBCS | | |
|---|---|---|
| Sample # | DW added wt. % | Phase Separation |
| 33 | 80 | no |
| 34 | 90 | no |

The results summarized in Table If below show the effect of adding varied amounts distilled water to Sample 0 modified by the addition of 80% by weight, based on total weight, POBCS.

TABLE If

| AS-1, 80% POBCS | | |
|---|---|---|
| Sample # | DW added wt. % | Phase Separation |
| 35 | 0 | yes |
| 36 | 20 | yes |
| 37 | 40 | yes |
| 38 | 50 | yes |
| 39 | 60 | partial |
| 40 | 80 | partial |
| 41 | 90 | no |

From Tables Ia–If it is apparent that AS-1 prevented phase separation in 22 of 35 samples containing POBCS. This demonstrates the effectiveness of AS-1 to improve the dispersion of POBCS in water over wide ranges of distilled water, AS-1 and POBCS concentrations.

The results are summarized in Table Ia below for auxiliary surfactant AS-2 with no POBCS added.

TABLE IIa

| AS-2, 0% POBCS | | |
|---|---|---|
| Sample # | DW added wt. % | Phase Separation |
| 0 | 0 | no |
| 1 | 20 | no |
| 2 | 40 | no |
| 3 | 50 | no |
| 4 | 60 | no |
| 5 | 80 | no |
| 6 | 90 | no |

This established that the AS-2 10% solution was fully miscible with water in all proportions in the absence of POBCS.

The results summarized in Table IIb below show the effect of adding varied amounts distilled water to Sample 0 modified by the addition of 20% by weight, based on total weight, POBCS.

TABLE IIb

| AS-2, 20% POBCS | | |
|---|---|---|
| Sample # | DW added wt. % | Phase Separation |
| 7 | 0 | no |
| 8 | 20 | no |
| 9 | 40 | no |
| 10 | 50 | no |

TABLE IIb-continued

| AS-2, 20% POBCS | | |
|---|---|---|
| Sample # | DW added wt. % | Phase Separation |
| 11 | 60 | no |
| 12 | 80 | no |
| 13 | 90 | no |

The results summarized in Table IIc below show the effect of adding varied amounts distilled water to Sample 0 modified by the addition of 40% by weight, based on total weight, POBCS.

TABLE IIc

| AS-2, 40% POBCS | | |
|---|---|---|
| Sample # | DW added wt. % | Phase Separation |
| 14 | 0 | no |
| 15 | 20 | no |
| 16 | 40 | no |
| 17 | 50 | no |
| 18 | 60 | no |
| 19 | 80 | no |
| 20 | 90 | no |

The results summarized in Table IId below show the effect of adding varied amounts distilled water to Sample 0 modified by the addition of 50% by weight, based on total weight, POBCS.

TABLE IId

| AS-2, 50% POBCS | | |
|---|---|---|
| Sample # | DW added wt. % | Phase Separation |
| 21 | 0 | no |
| 22 | 20 | no |
| 23 | 40 | no |
| 24 | 50 | no |
| 25 | 60 | no |
| 26 | 80 | no |
| 27 | 90 | no |

The results summarized in Table IIe below show the effect of adding varied amounts distilled water to Sample 0 modified by the addition of 60% by weight, based on total weight, POBCS.

TABLE IIe

| AS-2, 60% POBCS | | |
|---|---|---|
| Sample # | DW added wt. % | Phase Separation |
| 28 | 0 | no |
| 29 | 20 | no |
| 30 | 40 | no |
| 31 | 50 | no |
| 32 | 60 | no |
| 33 | 80 | no |
| 34 | 90 | no |

The results summarized in Table IIf below show the effect of adding varied amounts distilled water to Sample 0 modified by the addition of 80% by weight, based on total weight, POBCS.

TABLE IIf

| AS-2, 80% POBCS | | |
|---|---|---|
| Sample # | DW added wt. % | Phase Separation |
| 35 | 0 | no |
| 36 | 20 | partial |
| 37 | 40 | partial |
| 38 | 50 | partial |
| 39 | 60 | no |
| 40 | 80 | no |
| 41 | 90 | no |

From Tables IIa–IIf it is apparent that AS-2 prevented phase separation in 32 of 35 samples containing POBCS. This demonstrates the effectiveness of AS-1 to improve the dispersion of POBCS in water over wide ranges of distilled water, AS-1 and POBCS concentrations.

The results are summarized in Table IIIa below for auxiliary surfactant AS-3 with no POBCS added.

TABLE IIIa

| AS-3, 0% POBCS | | |
|---|---|---|
| Sample # | DW added wt. % | Phase Separation |
| 0 | 0 | partial |
| 1 | 20 | partial |
| 2 | 40 | partial |
| 3 | 50 | partial |
| 4 | 60 | partial |
| 5 | 80 | no |
| 6 | 90 | no |

This established that the auxiliary surfactant AS-3 solution is water soluble in limited concentrations, but not miscible with water in all proportions in the absence of POBCS. From the tables that follow, however, it is apparent that the 10% AS-3 solution was miscible with POBCS in all proportions.

The results summarized in Table IIIb below show the effect of adding varied amounts distilled water to Sample 0 modified by the addition of 20% by weight, based on total weight, POBCS.

TABLE IIIb

| AS-3, 20% POBCS | | |
|---|---|---|
| Sample # | DW added wt. % | Phase Separation |
| 7 | 0 | no |
| 8 | 20 | no |
| 9 | 40 | no |
| 10 | 50 | no |
| 11 | 60 | no |
| 12 | 80 | no |
| 13 | 90 | no |

The results summarized in Table IIIc below show the effect of adding varied amounts distilled water to Sample 0 modified by the addition of 40% by weight, based on total weight, POBCS.

TABLE IIIc

| AS-3, 40% POBCS | | |
|---|---|---|
| Sample # | DW added wt. % | Phase Separation |
| 14 | 0 | no |
| 15 | 20 | no |
| 16 | 40 | no |
| 17 | 50 | no |
| 18 | 60 | no |
| 19 | 80 | no |
| 20 | 90 | partial |

The results summarized in Table IIId below show the effect of adding varied amounts distilled water to Sample 0 modified by the addition of 50% by weight, based on total weight, POBCS.

TABLE IIId

| AS-3, 50% POBCS | | |
|---|---|---|
| Sample # | DW added wt. % | Phase Separation |
| 21 | 0 | no |
| 22 | 20 | no |
| 23 | 40 | no |
| 24 | 50 | no |
| 25 | 60 | no |
| 26 | 80 | no |
| 27 | 90 | yes |

The results summarized in Table IIIe below show the effect of adding varied amounts distilled water to Sample 0 modified by the addition of 60% by weight, based on total weight, POBCS.

TABLE IIIe

| AS-3, 60% POBCS | | |
|---|---|---|
| Sample # | DW added wt. % | Phase Separation |
| 28 | 0 | no |
| 29 | 20 | no |
| 30 | 40 | no |
| 31 | 50 | no |
| 32 | 60 | no |
| 33 | 80 | no |
| 34 | 90 | yes |

The results summarized in Table IIIf below show the effect of adding varied amounts distilled water to Sample 0 modified by the addition of 80% by weight, based on total weight, POBCS.

TABLE IIIf

| AS-3, 80% POBCS | | |
|---|---|---|
| Sample # | DW added wt. % | Phase Separation |
| 35 | 0 | no |
| 36 | 20 | no |
| 37 | 40 | no |
| 38 | 50 | no |
| 39 | 60 | no |

TABLE IIIf-continued

| AS-3, 80% POBCS | | |
|---|---|---|
| Sample # | DW added wt. % | Phase Separation |
| 40 | 80 | no |
| 41 | 90 | yes |

From Tables IIIa–IIIf it is apparent that AS-3 prevented phase separation in 31 of 34 samples containing POBCS. This demonstrates the effectiveness of AS-3 to improve the dispersion of POBCS in water over wide ranges of distilled water, AS-3 and POBCS concentrations.

The results are summarized in Table IVa below for auxiliary surfactant AS-4 with no POBCS added.

TABLE IVa

| AS-4, 0% POBCS | | |
|---|---|---|
| Sample # | DW added wt. % | Phase Separation |
| 0 | 0 | no |
| 1 | 20 | no |
| 2 | 40 | no |
| 3 | 50 | no |
| 4 | 60 | no |
| 5 | 80 | no |
| 6 | 90 | no |

This established that the AS-4 10% solution was fully miscible with water in all proportions in the absence of POBCS.

The results summarized in Table IVb below show the effect of adding varied amounts of distilled water to Sample 0 modified by the addition of 20% by weight, based on total weight, POBCS.

TABLE IVb

| AS-4, 20% POBCS | | |
|---|---|---|
| Sample # | DW added wt. % | Phase Separation |
| 7 | 0 | no |
| 8 | 20 | no |
| 9 | 40 | no |
| 10 | 50 | no |
| 11 | 60 | no |
| 12 | 80 | no |
| 13 | 90 | no |

The results summarized in Table IVc below show the effect of adding varied amounts distilled water to Sample 0 modified by the addition of 40% by weight, based on total weight, POBCS.

TABLE IVc

| AS-4, 40% POBCS | | |
|---|---|---|
| Sample # | DW added wt. % | Phase Separation |
| 14 | 0 | no |
| 15 | 20 | no |
| 16 | 40 | no |
| 17 | 50 | no |

TABLE IVc-continued

| AS-4, 40% POBCS | | |
|---|---|---|
| Sample # | DW added wt. % | Phase Separation |
| 18 | 60 | no |
| 19 | 80 | no |
| 20 | 90 | no |

The results summarized in Table IVd below show the effect of adding varied amounts distilled water to Sample 0 modified by the addition of 50% by weight, based on total weight, POBCS.

TABLE IVd

| AS-4, 50% POBCS | | |
|---|---|---|
| Sample # | DW added wt. % | Phase Separation |
| 21 | 0 | no |
| 22 | 20 | no |
| 23 | 40 | no |
| 24 | 50 | partial |
| 25 | 60 | partial |
| 26 | 80 | partial |
| 27 | 90 | yes |

The results summarized in Table IVe below show the effect of adding varied amounts distilled water to Sample 0 modified by the addition of 60% by weight, based on total weight, POBCS.

TABLE IVe

| AS-4, 60% POBCS | | |
|---|---|---|
| Sample # | DW added wt. % | Phase Separation |
| 28 | 0 | no |
| 29 | 20 | no |
| 30 | 40 | no |
| 31 | 50 | partial |
| 32 | 60 | yes |
| 33 | 80 | partial |
| 34 | 90 | yes |

The results summarized in Table IVf below show the effect of adding varied amounts distilled water to Sample 0 modified by the addition of 80% by weight, based on total weight, POBCS.

TABLE IVf

| AS-4, 80% POBCS | | |
|---|---|---|
| Sample # | DW added wt. % | Phase Separation |
| 35 | 0 | no |
| 36 | 20 | no |
| 37 | 40 | yes |
| 38 | 50 | yes |
| 39 | 60 | yes |
| 40 | 80 | yes |
| 41 | 90 | yes |

From Tables IVa–IVf it is apparent that AS-4 prevented phase separation in 17 of 34 samples containing POBCS. This demonstrates the effectiveness of AS-4 to improve the dispersion of POBCS in water over wide ranges of distilled water, AS-4 and POBCS concentrations.

The results are summarized in Table Va below for auxiliary surfactant AS-5 with no POBCS added.

TABLE Va

| AS-5, 0% POBCS | | |
|---|---|---|
| Sample # | DW added wt. % | Phase Separation |
| 0 | 0 | no |
| 1 | 20 | no |
| 2 | 40 | no |
| 3 | 50 | no |
| 4 | 60 | no |
| 5 | 80 | no |
| 6 | 90 | no |

This established that the AS-5 10% solution was fully miscible with water in all proportions in the absence of POBCS.

The results summarized in Table Vb below show the effect of adding varied amounts distilled water to Sample 0 modified by the addition of 20% by weight, based on total weight, POBCS.

TABLE Vb

| AS-5, 20% POBCS | | |
|---|---|---|
| Sample # | DW added wt. % | Phase Separation |
| 7 | 0 | yes |
| 8 | 20 | partial |
| 9 | 40 | no |
| 10 | 50 | no |
| 11 | 60 | no |
| 12 | 80 | no |
| 13 | 90 | no |

The results summarized in Table Vc below show the effect of adding varied amounts distilled water to Sample 0 modified by the addition of 40% by weight, based on total weight, POBCS.

TABLE Vc

| AS-5, 40% POBCS | | |
|---|---|---|
| Sample # | DW added wt. % | Phase Separation |
| 14 | 0 | yes |
| 15 | 20 | yes |
| 16 | 40 | yes |
| 17 | 50 | partial |
| 18 | 60 | no |
| 19 | 80 | no |
| 20 | 90 | no |

The results summarized in Table Vd below show the effect of adding varied amounts distilled water to Sample 0 modified by the addition of 50% by weight, based on total weight, POBCS.

TABLE Vd

| AS-5, 50% POBCS | | |
|---|---|---|
| Sample # | DW added wt. % | Phase Separation |
| 21 | 0 | yes |
| 22 | 20 | yes |
| 23 | 40 | yes |
| 24 | 50 | yes |
| 25 | 60 | partial |
| 26 | 80 | no |
| 27 | 90 | no |

The results summarized in Table Ve below show the effect of adding varied amounts distilled water to Sample 0 modified by the addition of 60% by weight, based on total weight, POBCS.

TABLE Ve

| AS-5, 60% POBCS | | |
|---|---|---|
| Sample # | DW added wt. % | Phase Separation |
| 28 | 0 | yes |
| 29 | 20 | yes |
| 30 | 40 | yes |
| 31 | 50 | yes |
| 32 | 60 | yes |
| 33 | 80 | no |
| 34 | 90 | no |

The results summarized in Table Vf below show the effect of adding varied amounts distilled water to Sample 0 modified by the addition of 80% by weight, based on total weight, POBCS.

TABLE Vf

| AS-5, 80% POBCS | | |
|---|---|---|
| Sample # | DW added wt. % | Phase Separation |
| 35 | 0 | yes |
| 36 | 20 | yes |
| 37 | 40 | yes |
| 38 | 50 | yes |
| 39 | 60 | yes |
| 40 | 80 | yes |
| 41 | 90 | partial |

From Tables Va–Vf it is apparent that AS-5 prevented phase separation in 12 of 34 samples containing POBCS. This demonstrates the effectiveness of AS-5 to improve the dispersion of POBCS in water at the higher tested AS-5 concentrations, independent of water concentrations, and at the higher tested water concentrations with lower AS-5 concentrations.

The results are summarized in Table VIa below for auxiliary surfactant AS-6 with no POBCS added.

TABLE VIa

| AS-6, 0% POBCS | | |
|---|---|---|
| Sample # | DW added wt. % | Phase Separation |
| 0 | 0 | no |
| 1 | 20 | no |
| 2 | 40 | no |
| 3 | 50 | no |
| 4 | 60 | no |
| 5 | 80 | no |
| 6 | 90 | no |

This established that the AS-6 10% solution was fully miscible with water in all proportions in the absence of POBCS.

The results summarized in Table VIb below show the effect of adding varied amounts distilled water to Sample 0 modified by the addition of 20% by weight, based on total weight, POBCS.

TABLE VIb

| AS-6, 20% POBCS | | |
|---|---|---|
| Sample # | DW added wt. % | Phase Separation |
| 7 | 0 | no |
| 8 | 20 | no |
| 9 | 40 | no |
| 10 | 50 | no |
| 11 | 60 | no |
| 12 | 80 | no |
| 13 | 90 | no |

The results summarized in Table VIc below show the effect of adding varied amounts distilled water to Sample 0 modified by the addition of 40% by weight, based on total weight, POBCS.

TABLE VIc

| AS-1, 40% POBCS | | |
|---|---|---|
| Sample # | DW added wt. % | Phase Separation |
| 14 | 0 | no |
| 15 | 20 | no |
| 16 | 40 | partial |
| 17 | 50 | partial |
| 18 | 60 | partial |
| 19 | 80 | partial |
| 20 | 90 | no |

The results summarized in Table VId below show the effect of adding varied amounts distilled water to Sample 0 modified by the addition of 50% by weight, based on total weight, POBCS.

TABLE VId

| AS-1, 50% POBCS | | |
|---|---|---|
| Sample # | DW added wt. % | Phase Separation |
| 21 | 0 | no |
| 22 | 20 | no |
| 23 | 40 | yes |
| 24 | 50 | yes |
| 25 | 60 | yes |
| 26 | 80 | yes |
| 27 | 90 | yes |

The results summarized in Table VIe below show the effect of adding varied amounts distilled water to Sample 0 modified by the addition of 60% by weight, based on total weight, POBCS.

TABLE VIe

| AS-6, 60% POBCS | | |
|---|---|---|
| Sample # | DW added wt. % | Phase Separation |
| 28 | 0 | no |
| 29 | 20 | no |
| 30 | 40 | yes |
| 31 | 50 | yes |
| 32 | 60 | yes |
| 33 | 80 | yes |
| 34 | 90 | yes |

The results summarized in Table VIf below show the effect of adding varied amounts distilled water to Sample 0 modified by the addition of 80% by weight, based on total weight, POBCS.

TABLE VIf

| AS-6, 80% POBCS | | |
|---|---|---|
| Sample # | DW added wt. % | Phase Separation |
| 35 | 0 | no |
| 36 | 20 | no |
| 37 | 40 | yes |
| 38 | 50 | yes |
| 39 | 60 | yes |
| 40 | 80 | yes |
| 41 | 90 | yes |

From Tables VIa–VIf it is apparent that AS-6 prevented phase separation in 10 of 34 samples containing POBCS. This demonstrates the effectiveness of AS-6 to improve the dispersion of POBCS in water when a higher concentration of the auxiliary surfactant is employed or a limited concentration of POBCS is employed.

When the data from Tables Ia through VIf are viewed together, it is apparent that every water, auxiliary surfactant and POBCS proportion tested is capable of mixing without phase separation, with each individual auxiliary surfactant being effective over a large portion of the proportion ranges.

Dispersion Comparison to Methanol

Pluronic 31R1™ (POBCS) in the amount of 680 grams was dispersed in methanol to a volume of 1 liter, hereinafter labeled MeOH-Control.

For comparison single phase (clear) dispersions of the three component mixtures of (a) a 10% by weight solution of AS-1 in water, (b) POBCS and (c) distilled water in the following proportions:

TABLE VII

| Sample | % (a) | % (b) | % (c) |
|---|---|---|---|
| A | 10 | 10 | 80 |
| B | 20 | 20 | 60 |
| C | 5 | 20 | 75 |
| D | 10 | 10 | 80 |

When MeOH-Control was added to 1000 g of water at 50° C. in the amount of 1 mL, an immediate phase separation was observed, with droplets of MeOH-Control being observed clinging to the bottom of the liquid container and on the surface of the liquid.

When Sample A was substituted for MeOH-Control slight turbidity was observed when the concentration of Sample A reached 7 mL.

When Sample B was substituted for MeOH-Control slight turbidity was observed when the concentration of Sample B reached 3.5 mL.

When Sample C was substituted for MeOH-Control turbidity with some phase separation was observed when the concentration of Sample A reached 3.5 mL.

These results demonstrate that the use of auxiliary surfactants in place of methanol is capable of producing more uniform dispersions of POBCS.

Three Component Mixtures with Varied Polyalkylene Oxide Block Copolymer Surfactants A series of dispersions were prepared using varied (b) polyalkylene oxide block copolymer surfactants (POBCS) in distilled water (c), with and without a 10% by weight aqueous solution of AS-1 (a) being present. The results are summarized in Table VIII.

TABLE VIII

| POBCS | wt. ratios (b):(a):(c) | Appearance |
|---|---|---|
| Pluronic ™31R1 | | |
| Formula (II) | 12.5:0:87.5 | turbid |
| x/y/x' = 25/7/25 | 10:10:80 | clear |
| Pluronic ™25R2 | | |
| Formula (II) | 12.5:0:87.5 | turbid |
| x/y/x' = 22/14/22 | 10:10:80 | clear |
| Pluronic ™25R2 | | |
| Formula (II) | 12.5:0:87.5 | turbid |
| x/y/x' = 22/14/22 | 10:10:80 | clear |
| Pluronic ™L101 | | |
| Formula (IV) | 12.5:0:87.5 | turbid |
| y/x/y' = 4/59/4 | 10:10:80 | clear |
| Pluronic ™L81 | | |
| Formula (IV) | 12.5:0:87.5 | turbid |
| y/x/y' = 3/43/3 | 10:10:80 | clear |
| Pluronic ™L61 | | |
| Formula (IV) | 20:0:80 | turbid |
| y/x/y' = 3/43/3 | 19:19:62 | clear |

Table VIII demonstrates that varied forms of the Formula II and IV polyalkylene oxide block copolymer surfactants were dispersed without phase separation when employed in combination with an auxiliary surfactant according to the invention.

Effects of Methanol and Auxiliary Surfactants on the Physical Characteristics of Emulsion Grains Emulsion 1 (Control)

To a reaction vessel containing 2.52 g of low methionine gelatin, 2 g of the MeOH-Control methanol solution of Pluronic™ 31R1, 5.56 g of sodium bromide, 4464.78 g of water and maintained at 45° C., 16 mL of a solution of 4.0 M nitric acid was added and a 0.35 M solution of silver nitrate were added at a rate of 28.6 mL/min for one minute, followed by the addition of a 2.5 M solution of sodium bromide at the rate of 26.7 ml/min for one minute. Sixteen mL of a solution containing 11.21 g of ammonium sulfate were added to the reactor and the temperature of the reactor was increased to 60° C. over a period of 9 minutes. A 76 mL solution of 2.5 M sodium hydroxide was added to the reactor, and, after 9 minutes, 155 mL of a 4 M solution of nitric acid and 1499 mL of a solution containing 150.02 g of low methionine gelatin and 0.2215 g of the MeOH-Control methanol solution of Pluronic™ 31R1 were added to the reactor. A 2.5 M solution of sodium bromide was added to the reactor at the rate of 20.3 mL/min for 4 minutes, and a 0.35 M solution of silver nitrate was added for 10.4 minutes, at a linear ramp rate starting at 14.5 mL/min and increasing to 60.0 mL/min in 10.4 minutes. Over the next 15.8 minutes, a 0.35 M solution of silver nitrate was added as a linear ramp of 1.58 mL/min$^2$ starting at a rate of 60 mL/min, while the pBr of the reactor was maintained at ca. 1.72 using a 2.5 M sodium bromide solution. A 2.4 M solution of silver nitrate was added at a linear ramp rate of 0.77 mL/min$^2$ for 70 minutes, starting at 12.4 mL/min, with the pBr being maintained at ca. 1.72 using a 2.5 M sodium bromide solution. Continuing at the same ramp rate and pBr, 64 mL of a solution of potassium hexacyanoruthenate (3.5 g/liter) was added at the rate of 59.5 mL/min for one minute.

The resultant emulsion was then cooled to 40° C., washed, concentrated and characterized to have an average grain ECD of 3.97 μm and an average thickness of 0.094 μm. The COV of grain ECD was 27%. Tabular grains accounted for greater than 70 percent total grain projected area.

Emulsion 2 (Control)

This emulsion was prepared in the same manner as Emulsion 1, except that the methanol solution of PLURONIC™ 31R1 was omitted.

The resultant emulsion was characterized to have an average grain ECD of 8.57 μm and an average grain thickness of 0.094 μm. The COV of grain ECD was 27%. Tabular grains accounted for greater than 70 percent of total grain projected area.

Emulsion 3

This emulsion was prepared in the same manner as Emulsion 1, except that the methanol solution of PLURONIC™ 31R1 was replaced with the three component dispersion consisting of 10% of a 10% by weight solution of AS-1, 10% Pluronic™ 31R1 and 80% distilled water.

The resultant emulsion was characterized to have an average grain ECD of 4.02 μm and an average grain thickness of 0.092 μm. The COV of grain ECD was 28%. Tabular grains accounted for greater than 70 percent of total grain projected area.

Emulsion 4

This emulsion was prepared in the same manner as Emulsion 1, except that the methanol solution of PLURONIC™ 31R1 was replaced with the three component dispersion consisting of 10% of a 10% by weight solution of AS-2, 10% Pluronic™ 31R1 and 80% distilled water.

The resultant emulsion was characterized to have an average grain ECD of 4.46 μm and an average grain thickness of 0.104 μm. The COV of grain ECD was 26%. Tabular grains accounted for greater than 70 percent of total grain projected area.

By comparing the physical characteristics of Emulsions 1 to 4, it is apparent that the polyalkylene oxide was as effective in reducing grain dispersity when dispersed using an auxiliary surfactant as when dispersed using methanol. Thus, the auxiliary surfactants offer the advantage of eliminating a volatile organic compound from the manufacturing process.

Effects of Methanol and Auxiliary Surfactants on the Performance Characteristics of Emulsions Sensitizers and Addenda:

Compound A (Cmpd-A)=sodium thiocyanate

Compound B (Cmpd-B)=N-methylsulfamoylethylbenzothiazolium tetrafluoroborate

Compound C (Cmpd-C)=4-hydroxy-1,3,3a,7-tetraazaindene

Compound D (Cmpd-D)=2-[2,4-bis(1,1-dimethylpropyl)phenoxy-N-{4-[{[(4-cyanophenyl)amino]carbonyl}amino]-3-hydroxyphenyl}hexanamide Chemical Sensitizer A (CS-A)=sodium aurous(I) dithiosulfate hydrate Chemical Sensitizer B (CS-B)=sodium thiosulfate pentahydrate Spectral Sensitizing Dye A (SS-A)=Anhydro-5-chloro-9-ethyl-5'-phenyl-3'-(3-sulfobutyl)-3-(3-sulfopropyl) oxacarbocyanine hydroxide, sodium salt Spectral Sensitizing Dye B (SS-B)=Anhydro-3,9-diethyl-3'-methylsulfonylcarbamoylmethyl-5-phenyloxathiocarbocyanine hydroxide Sensitization and Evaluation Procedure Each of the emulsions was separately treated in the following manner, all concentrations of compounds added being given on a per mole of silver halide basis: To the liquid emulsion at 40° C. were added 100 mg of Cmpd-A, followed by 35 mg of Cmpd-B, followed by 1.2 mmol of SS-A, followed by 0.3 mmol of SS-B, followed by 3 mg of CS-A and 1.5 mg of CS-B. The emulsions were then heated to 65° C. and held for 15 minutes before cooling back to 40° C., following which were added 1.8 g of Cmpd-C.

The resulting sensitized emulsion samples were then mixed additional water in preparation for coating. A separate melt composed gelatin, Cmpd-C, an oil-in-water dispersion of Cmpd-D, and conventional coating surfactants were mixed in equal volumes with the emulsion melt immediately before casting onto a cellulose triacetate support. This emulsion layer was then protected by a gelatin overcoat comprised of coating surfactants and bis(vinylsulfonylmethyl)ether. The dried coatings so produced contained 1.29 g/m$^2$ Ag, 5.1 g/m$^2$ gelatin, 0.97 g/m$^2$ Cmpd-D.

Each coating was exposed for 0.02 second through a stepped density tablet, a 0.3 density Inconel neutral density filter, and a Kodak Wratten™ 9 filter (transmits at wavelengths longer than 460 nm) with 5500K light. Exposed strips were then process for 2 minutes, 30 seconds in the Kodak Flexicolor™ C-41 color negative process.

The results are summarized in Table IX

TABLE IX

| Emulsion (+) | $D_{min}$ | Speed* | Gamma | GNG** |
|---|---|---|---|---|
| 1 (MeOH) | 0.06 | 242 | 2.87 | 1.21 |
| 2 (none) | 0.08 | 276 | 1.95 | 1.44 |
| 3 (AS-1) | 0.06 | 248 | 3.08 | 1.18 |
| 4 (AS-2) | 0.07 | 255 | 2.77 | 1.25 |

*inertial speed, 100 units = 1.0 log E
**gamma normalized granularity

Emulsion 2, prepared without a POBCS present, had a much larger mean ECD than the remaining emulsions and a higher grain COV. Hence its higher speed and lower contrast was not unexpected.

The performance of Emulsion 1, which used POBCS surfactant with methanol was quite similar to that of Emulsions 3 and 4 that substituted auxiliary surfactants AS-1 and AS-2. This demonstrated that the objectionably volatile organic solvent could be eliminated by use of an auxiliary surfactant without any significant change in photographic performance.

The invention has been described in detail with particular reference to preferred embodiments thereof, but it will be understood that variations and modifications can be effected within the spirit and scope of the invention.

What is claimed is:

1. A process of preparing a radiation-sensitive silver halide emulsion comprising reacting silver and halide ions in an aqueous dispersing medium to form radiation-sensitive silver halide grains in the presence of a polyalkylene oxide block copolymer surfactant, WHEREIN dispersion of the polyalkylene oxide block copolymer surfactant in the aqueous dispersing medium is increased by the inclusion of an auxiliary surfactant that, in the form of an aqueous solution containing 10 percent by weight of the auxiliary surfactant based on total weight of the aqueous solution, is miscible in all proportions with at least one of water and the polyalkylene oxide block copolymer surfactant.

2. A process according to claim 1 wherein the auxiliary surfactant, in the form of an aqueous solution containing 10 percent by weight of the auxiliary surfactant based on total weight of the aqueous solution, is miscible in all proportions with water.

3. A process according to claim 1 wherein the auxiliary surfactant, in the form of an aqueous solution containing 10 percent by weight of the auxiliary surfactant based on total weight of the aqueous solution, is miscible in all proportions with the polyalkylene oxide block copolymer surfactant.

4. A process according to claim 1 wherein the auxiliary surfactant, in the form of an aqueous solution containing 10 percent by weight of the auxiliary surfactant based on total weight of the aqueous solution, is miscible in all proportions with water and with the polyalkylene oxide block copolymer surfactant.

5. A process according to claim 1 wherein the auxiliary surfactant is an anionic surfactant.

6. A process according to claim 1 wherein the auxiliary surfactant is a cationic surfactant.

7. A process according to claim 1 wherein the auxiliary surfactant is a non-ionic surfactant.

8. A process according to claim 1 wherein the polyalkylene oxide block copolymer surfactant satisfies the formula:

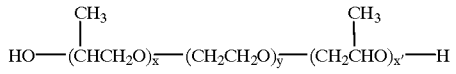

where x and x' are each from 6 to 120 and y is 2 to 240.

9. A process according to claim 1 wherein the polyalkylene oxide block copolymer surfactant satisfies the formula:

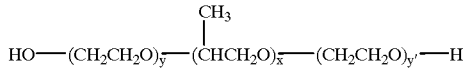

where x is 13 to 490 and y and y' are each from 1 to 240.

10. A process according to claim 1 wherein the silver halide grains contain greater than 50 mole percent bromide, based on silver.

11. A process according to claim 10 wherein the silver halide emulsion is a tabular grain emulsion containing tabular grains with {111} major faces.

* * * * *